US005158026A

United States Patent [19]

Badillo et al.

[11] Patent Number: 5,158,026

[45] Date of Patent: Oct. 27, 1992

[54] KIT ASSEMBLY ADAPTED FOR USE WITH A PROGRAMMABLE SEWING MACHINE

[75] Inventors: Ralph Badillo; Badillop Paul, both of Littleton, Colo.

[73] Assignee: Ralph's Industrial Sewing Machine Company, Denver, Colo.

[21] Appl. No.: 633,497

[22] Filed: Dec. 26, 1990

[51] Int. Cl.[5] ..... D05B 3/06; D05B 83/00

[52] U.S. Cl. ..... 112/68; 112/70; 112/261; 112/264.1

[58] Field of Search ..... 112/68, 447, 122, 130, 112/264.1, 261, 66, 70, 73

[56] References Cited

U.S. PATENT DOCUMENTS

| | | | |
|---|---|---|---|
| 345,663 | 7/1886 | Blodgett . | |
| 1,225,247 | 5/1917 | Hill . | |
| 1,650,588 | 11/1927 | Allen . | |
| 2,515,740 | 7/1950 | Smith et al. | 112/66 |
| 2,954,001 | 9/1960 | Luxenburg | 112/66 |
| 3,111,921 | 11/1963 | Kleemann et al. | 112/122 X |
| 3,948,194 | 4/1976 | Gunold | 112/122 X |
| 4,077,340 | 3/1978 | Braun et al. | 112/131 |
| 4,501,207 | 2/1985 | Miyazaki et al. | 112/447 X |
| 4,587,358 | 5/1986 | Goldbeck et al. | 112/68 |
| 4,735,160 | 4/1988 | Hampel et al. | 112/261 X |
| 5,085,157 | 2/1992 | Jung et al. | 112/68 |

FOREIGN PATENT DOCUMENTS 7634151 10/1976 Fed. Rep. of Germany .

*Primary Examiner*—Werner H. Schroeder
*Assistant Examiner*—Paul C. Lewis
*Attorney, Agent, or Firm*—Sheridan Ross & McIntosh

[57] ABSTRACT

A kit assembly for use in combination with sewing machines for purposes of removing portions of stitchable material around which a buttonhole or other desirable design is sewn by the sewing machine. In one embodiment, the kit includes a support assembly, a material removal device positioned within the support assembly, and a driver connected to the material removal device to supply the necessary forces to remove portions of material. The kit assembly may be attached to a sewing machine without requiring any substantial modification thereof and, if properly positioned, will not interfere with sewing operations and the components associated therewith. The kit assembly may be removed or disabled to allow the sewing machine to perform functions other than sewing buttonholes.

3 Claims, 7 Drawing Sheets

KIT ASSEMBLY ADAPTED FOR USE WITH A PROGRAMMABLE SEWING MACHINE

FIELD OF THE INVENTION

This invention generally relates to an apparatus which removes material to create a hole around which a pattern or other stitching may be sewn to produce a buttonhole or other desirable design and, more particularly, to a kit assembly which may be attached to a programmable sewing machine without requiring essentially any structural modification thereof to allow such machines to perform multiple functions.

BACKGROUND OF THE INVENTION

A number of programmable sewing machines have been devised and are currently available on the market today, one of which is the Model AMS-206A by Juki. Sewing machines of this type offer a number of advantages. For instance, sewing operations are controlled by computer software. More particularly, sewing patterns stored in computer memory and accessible by the software are used to control the movement of a presser foot assembly which engages and moves the stitchable material relative to the sewing needle to produce a desired, preselected pattern. Consequently, programmable sewing machines are commonly used in commercial, high production applications.

One of the many uses of programmable sewing machines is for sewing a selected patterned design around an opening in stitchable material to produce a buttonhole or other desirable design. Although no presently known programmable sewing machine incorporates a punch or other assembly for removing stitchable material, there are separate punching machines commercially available. Utilizing a separate punching machine with a programmable sewing machine, however, is disadvantageous in that not only is more space required, but the additional punching machine increases both the initial capital expenditure and subsequent maintenance costs. Furthermore, the capabilities of the programmable sewing machine may not be fully realized in this type of configuration.

Unlike programmable sewing machines, there are non-programmable sewing machines commercially available which integrate a punch assembly with sewing operations, but not in kit form. U.S. Pat. Nos. 345,663 to Blodgett, issued Jul. 20, 1886; 1,225,247 to Hill, issued May 8, 1917; 1,650,588 to Allen, issued Nov. 29, 1927; and 2,515,740 to Smith, et al., issued Jul. 18, 1950 are representative of this type of machine. Although configurations of this type alleviate the need for a separate punching machine, a number of disadvantages are evident based primarily upon the complex manner in which the drive assemblies for sewing and punching operations are typically coupled and integrated. For instance, maintenance costs for these machines are increased since they are both more difficult to repair and since there are additional parts which are subject to wear and/or breakage. Moreover, the complex integration of both operations effectively limits the use of these machines to one function—that of sewing buttonholes. Relatedly, in order to possibly limit the increase in size necessitated by adding the punching assembly, machines of this type commonly perform punching and sewing operations in the same general area, that being the cylinder bed.

Although welting machines cannot be used for buttonhole sewing operations, such machines do typically perform a material cutting operation outside the cylinder bed. Welting machines are used to form welts for pockets on coats and other articles of clothing. A typical welting machine initially places two end cuts on the material to define the ends of the pocket by utilizing the upward movement of knives positioned outside the cylinder bed. The machine then transfers the material to the cylinder bed to align one of the end cuts with a downwardly reciprocating knife and a sewing needle which are positioned in close proximity to each other. As the material is advanced, the reciprocating knife cuts the material toward the second end cut while the trailing needle sews the welt. Welting machines, however, are generally limited to a single function due to the manner in which the cutting and sewing operations are integrated. Moreover, although there is a material cutting operation performed outside the cylinder bed, no amount of material is removed since the upwardly reciprocating knife merely separates the fibers forming the material.

One known apparatus has addressed the need for a detachable punch assembly. U.S. Pat. No. 2,954,001 to Luxenburg, issued Sep. 27, 1960, generally discloses an automatic eyelet attachment. The eyelet attachment, which includes a punch and presser foot, is positioned on a standard non-programmable sewing machine in place of the original presser foot. When sewing an eyelet, the punch penetrates and spreads fibers but does not actually remove any substantial amount of material. With the punch remaining in the material, the needle stitches a pattern therearound to form the eyelet. A disadvantage of a punch of this type is that the material tends to pucker when the punch is inserted, resulting in a product which may be aesthetically displeasing. Consequently, this puts a realistic limitation on the size of the eyelet that can be produced since larger punches of this type will only increase puckering. Moreover, the punching operation takes place in the sewing area or cylinder bed since the needle actually sews around the punch while in the material to form the eyelet. Furthermore, positioning this eyelet attachment on a programmable sewing machine which automatically advances the stitchable material by movement of the presser foot assembly would not appear to provide an operational system. More particularly, the presser foot assembly of a programmable sewing machine moves during sewing operations which would introduce a problem since the punch disclosed by Luxenburg, which is attached to the presser foot, remains in the material while the eyelet is sewn.

SUMMARY OF THE INVENTION

The kit assembly of the present invention for removing stitchable material may be detachably connected to various types of sewing machines, but is particularly suited for use with those which are programmable. Generally, the kit assembly removes portions of stitchable material to produce an opening or hole around which a buttonhole or other desirable design may be sewn. When used with a programmable sewing machine, preferably the material removal operations, like sewing operations, are controlled by software to provide a fully automated system.

In the preferred embodiment, the present invention includes three primary components, namely a support assembly, a material removal device and a driver. The support assembly is detachably connected to the programmable sewing machine and is configured so as to not interfere with the machine's sewing operations, including its drive assembly. In one embodiment the support assembly includes a housing, mounted on the end of the head of the machine, which contains the material removal device and a table with a recessed receiver, mounted substantially adjacent to and parallel with the cylinder bed, which supports the stitchable material and receives the material removal device after it has completely extended therethrough.

The material removal device, most commonly a punch or any other suitable device such as a cutting tool, which removes the desired portions of stitchable material has a shaft that, in one embodiment, is positioned within a sleeve-lined bore in the housing to limit deflection of the material removal device when used on thicker, more resilient stitchable materials, and a cutting head configured to produce the desired contour of the opening which, in one embodiment, is removable from the shaft to allow for easy change of the contour of the opening, i.e., change the shape of the opening from a buttonhole to a different shaped opening. Attached to the material removal device is the driver which provides the necessary driving forces for material removal operations. Although the driver may be positioned within the housing, in one embodiment, the driver is an air cylinder positioned above the head of the programmable sewing machine so that the sewing drive assembly does not limit the size of the air cylinder.

The driver may be manually actuated, although in one embodiment it is controlled by software when used with a programmable sewing machine so as to provide fully automated buttonhole sewing operations. In this embodiment, the driver is automatically activated to propel the cutting head of the material removal device down through the stitchable material and into the recessed receiver in the table to remove the desired portion of stitchable material.

When the embodiment utilizing the housing, table, and software-controlled driver is used with a programmable sewing machine, buttonhole sewing operations begin by placing the stitchable material in the presser foot assembly and engaging its upper and lower components to securely grip the material therebetween. Typically, the presser foot assembly has an opening through which both the sewing needle and cutting head of the material removal device may pass. After initializing the positioning of the presser foot assembly and the stitchable material and selecting the desired sewing pattern, the software activates the driver controllers to propel the cutting head down through the stitchable material to produce an opening therein, after which the cutting head enters the receiver on the table.

When the driver controllers retract the material removal device, the presser foot assembly, maintaining its gripping pressure on the stitchable material, is moved by the controllers as directed by the software over to the sewing area to align the opening in the stitchable material with the hole in the cylinder bed through which the sewing needle passes. A preselected pattern, stored in computer memory and accessed by the software, is then sewn around the opening in the stitchable material by movement of the presser foot assembly as is known in the art to produce a buttonhole or other desirable design.

Although the buttonhole sewing operations sequence has been described as such, it can be appreciated that the sequence may be reversed. More particularly, operations may be initiated by first sewing the desired pattern on the stitchable material and then transferring this portion to the material removal area where the material removal device will then produce the desired opening or hole inside of the pre-stitched pattern. The end product utilizing this alternate sequence is generally the same as otherwise presented herein, except that the hole will not have stitched border on the interior thereof.

The kit assembly of the present invention provides advantages not found in any known material removal apparatus. For instance, the kit itself allows sewing machines, particularly those which are programmable, to be used for functions other than only sewing buttonholes which increases versatility and thus cost effectiveness. Moreover, no significant structural modification of the sewing machine is typically required, although material removal operations are performed sufficiently close to the sewing area so as to not adversely affect the speed of sewing operations. This is particularly advantageous when the present invention is used with programmable sewing machines which are often used in industrial, high production applications.

DETAILED DESCRIPTION

The kit assembly 12 of the present invention will be described with reference to the accompanying drawings which illustrate its pertinent features. Although the kit assembly 12 may be used with standard sewing machines, it is particularly advantageous when used in combination with a programmable sewing machine 16 of the type illustrated in FIG. 1 to provide fully automated buttonhole sewing operations.

Figure 1:
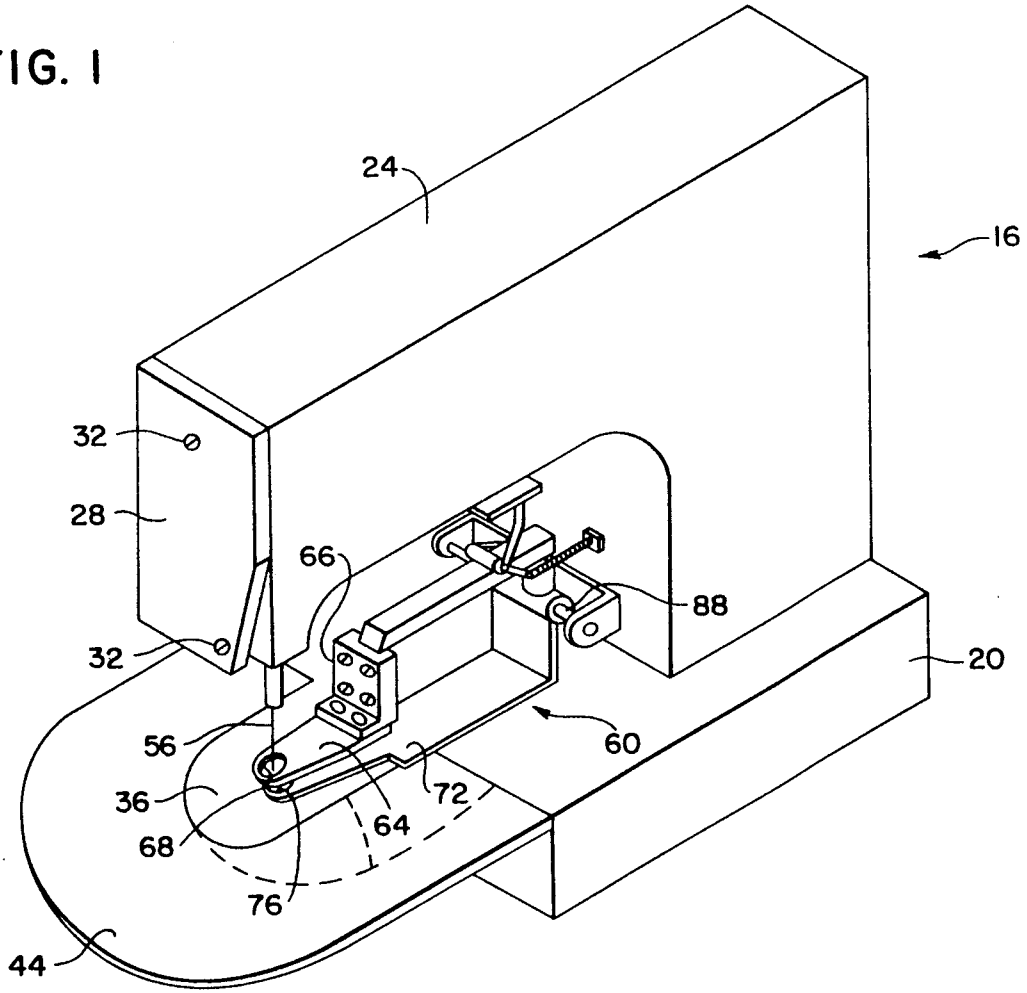
FIG. 1 is a perspective view of a known programmable sewing machine.

With reference primarily to FIG. 1, the programmable sewing machine 16 typically includes a base 20 which functions as a support, a head 24 which contains a portion of the sewing drive assembly 48 (FIG. 3), a detachable head cover 28 for accessing the sewing drive assembly 48 (FIG. 3), a cylinder bed 36 which contains sewing components assembly 52 (FIGS. 3, 5, and 7) which interact with the sewing needle 56 to produce the desired stitch, a detachable support plate 44 which is positioned around the cylinder bed 36 to provide a surface for supporting the material to be stitched (FIG.

Figure 2:
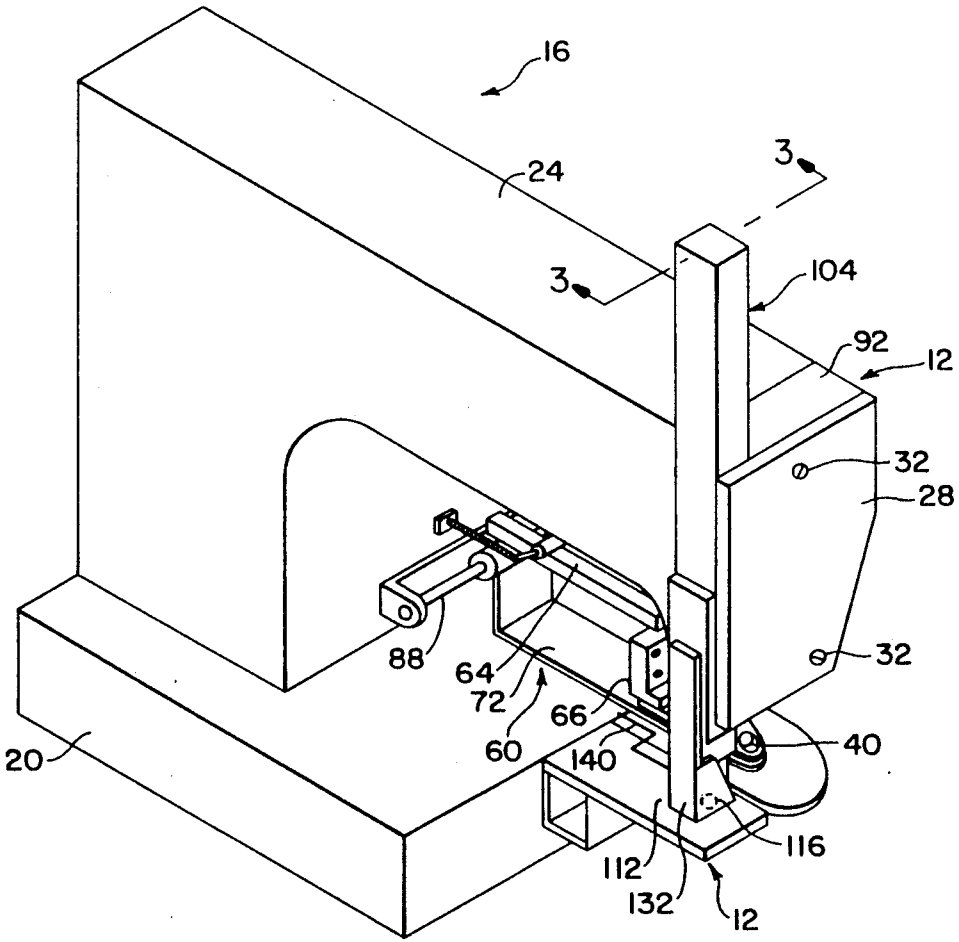
FIG. 2 is a perspective view of the programmable sewing machine incorporating a kit assembly of the present invention.

1), and a presser foot assembly 60 (FIG. 1) which moves the material to be stitched relative to the sewing needle 56 to produce the desired pattern. In order to produce this movement of the presser foot assembly 60, a programmable computer (not shown) governs control motors (not shown) which in turn direct the movement of the presser foot assembly 60 along and relative to the cylinder rod 88 (FIG. 2). Consequently, various stitching patterns may be stored in computer memory and accessed by the software to produce a preselected design.

One embodiment of the kit assembly 12 is illustrated in FIG. 2 as it would be typically attached to a programmable sewing machine 16. The kit assembly 12 generally includes a support assembly 92 which is detachably connected to the end of the head 24 for 25 containing the material removal device 120 (FIGS. 3–4), a driver 104 positioned above the head 24 which is coupled to and drives the material removal device 120, a table 112 which is detachably connected to the programmable sewing machine 16 substantially adjacent to and parallel with the cylinder bed 36, and a guard 132 which is pivotally attached to the support assembly 92 to protect against inadvertent dislodging of the material removal device 120 during sewing operations.

The support assembly 92 is configured to position the material removal device 120 contained therein so as to not interfere with the sewing drive assembly 48 or the sewing components assembly 52, including the sewing needle 56, of the programmable sewing machine 16. In one embodiment illustrated in FIGS. 3–4, a bore 96, positioned within the support assembly 92 and extending substantially vertically therethrough, guides the material removal device 120. This configuration reduces the deflection of the material removal device 120 when used on thicker and/or more resilient stitchable materials 144. In order to provide for a more frictionless engagement between the material removal device 120 and the bore 96, a sleeve bearing 100 of the type well known in the art is positioned therebetween.

The material removal device 120 generally includes a shaft 124, positioned within the bore 96 and coupled with the driver shaft 108 of the driver 104 by methods such as threaded engagement, and a cutting head 128 which removes stitchable material 144 to produce an opening of a desired contour. As can be appreciated, the cutting head 128 may be alternately configured to produce various contours of openings. Furthermore, the cutting head 128 may be a punch, cutting tool or any other suitable device for removing material. Although the shaft 124 and the cutting head 128 of the material removal device 120 may be integrally formed, the cutting head 128 in one embodiment is detachably connected to the shaft 124 by methods such as threaded engagement.

Figure 3:
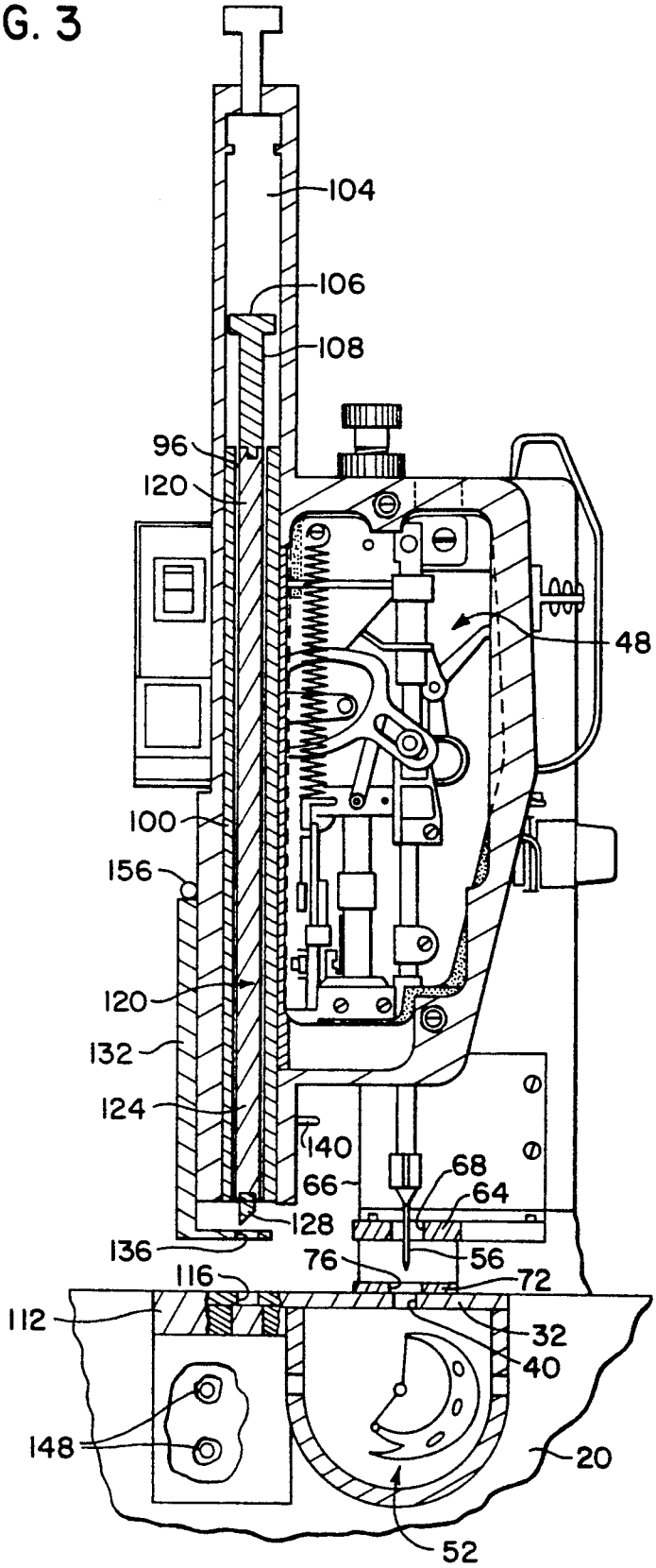
FIG. 3 is a cross-sectional view of the kit assembly of FIG. 2 taken along line 3—3.
Figure 4:
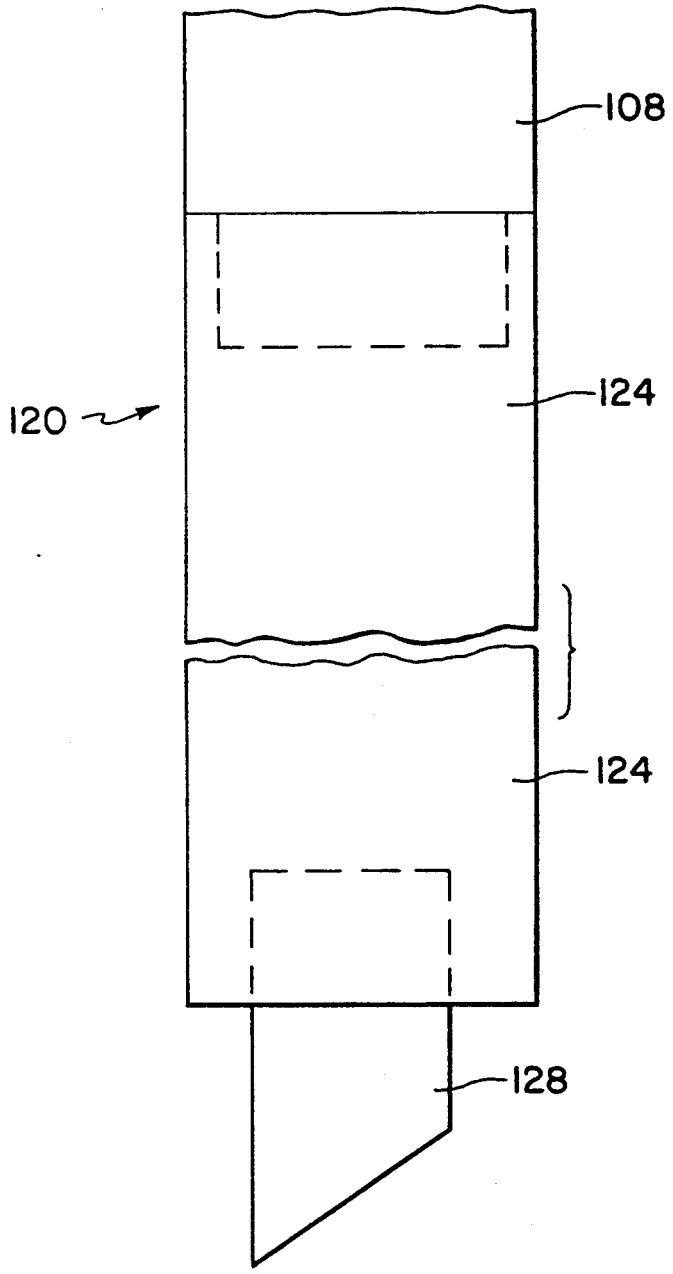
FIG. 4 is an enlarged view of the material removal device and its detachable connections.

The material removal device 120 is coupled with the driver 104 which supplies the necessary driving forces for material removal operations as best illustrated in FIGS. 3–4. Although numerous types of drivers 104 may be used and placed in a variety of positions, in one embodiment the driver is an air cylinder which is positioned above the head 24 and driven by an appropriate source (not shown). This positioning is advantageous in that a larger capacity driver 104, in this case an air cylinder having a driver piston 106 and driver shaft 108, may be used (i.e., more force application capacity) without interfering with the sewing drive assembly 48 or the sewing components assembly 52.

Figure 5:
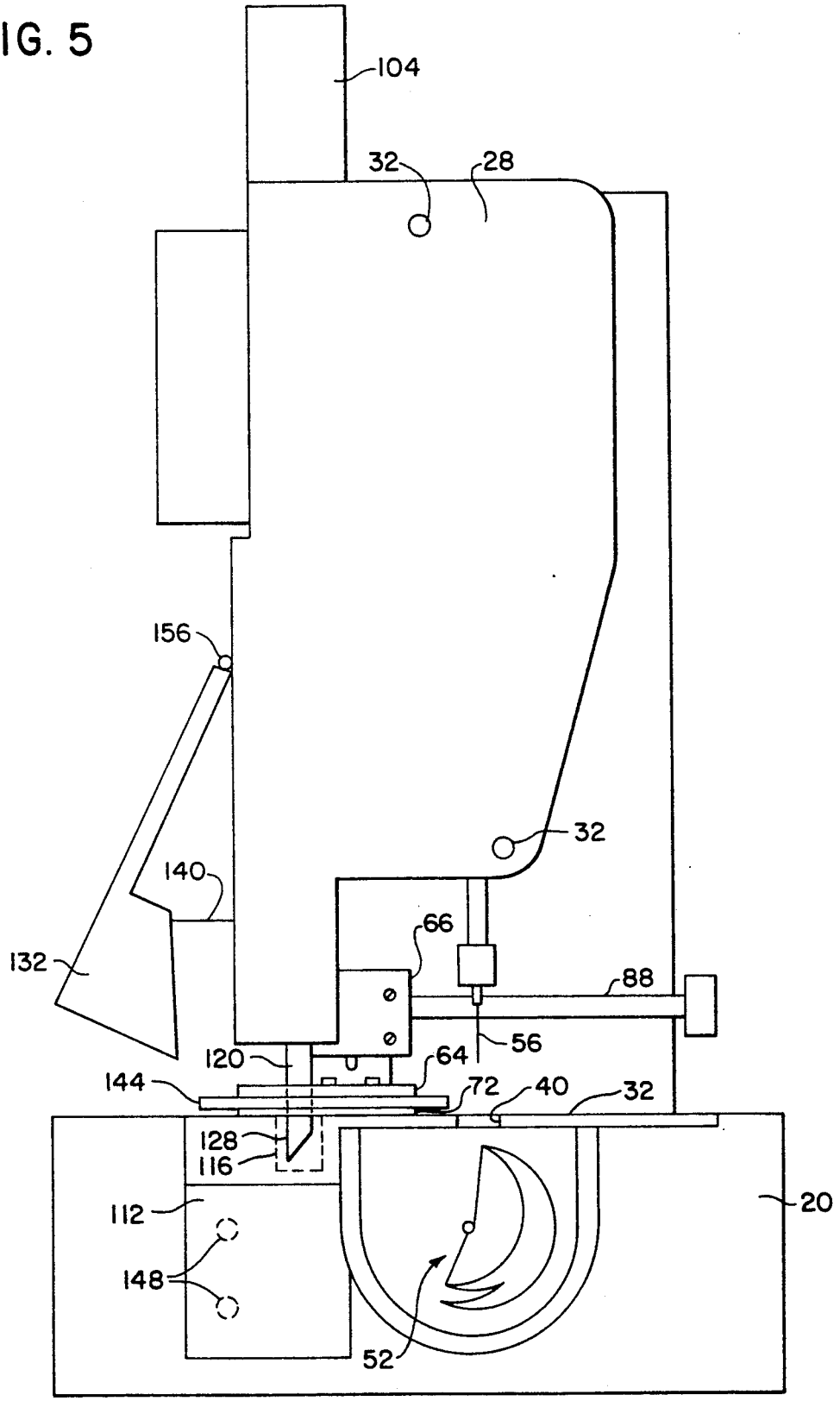
FIG. 5 is a front view of the programmable sewing machine with the kit assembly attached thereto, illustrating the positioning of the presser foot assembly and guard during material removal operations.
Figure 6:
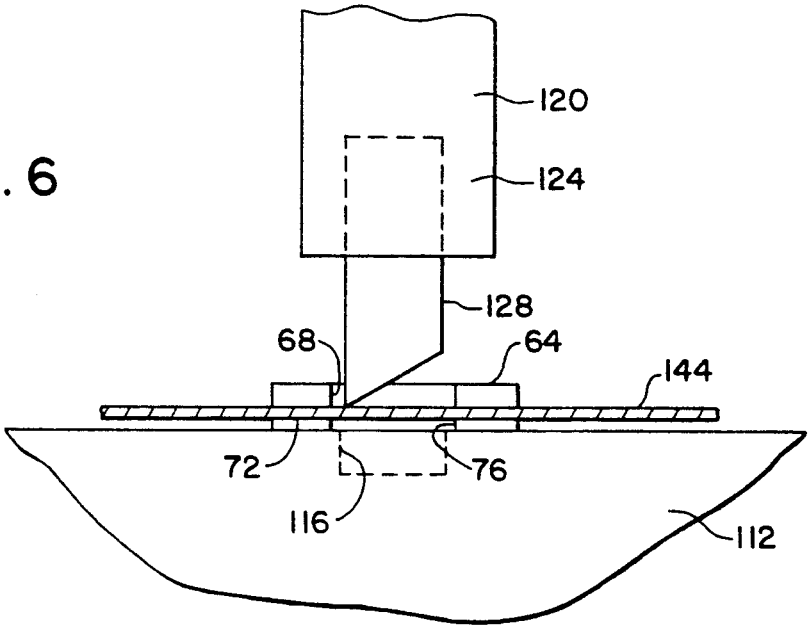
FIG. 6 is an enlarged front view of the material removal device during material removal operations.
Figure 8:
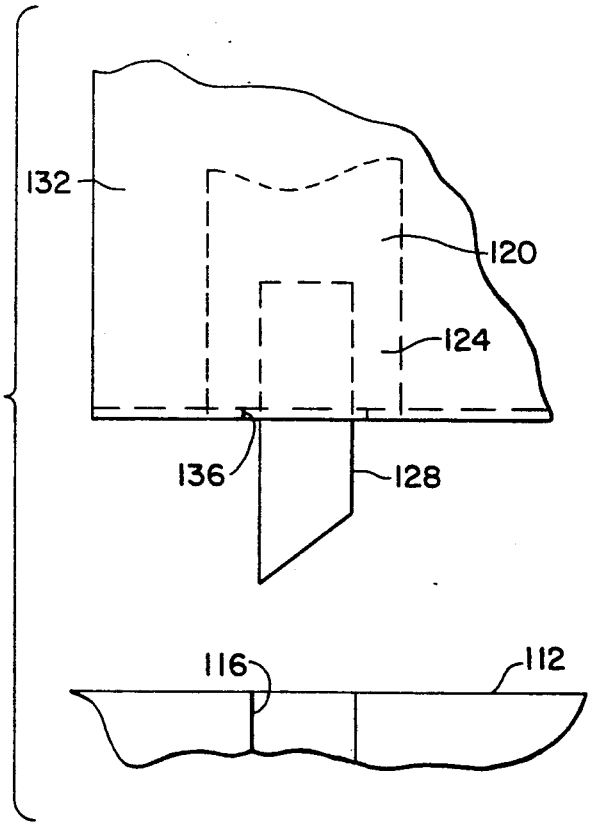
FIG. 8 is an enlarged front view illustrating the restricting of the downward movement of the material removal device by the guard.
Figure 7:
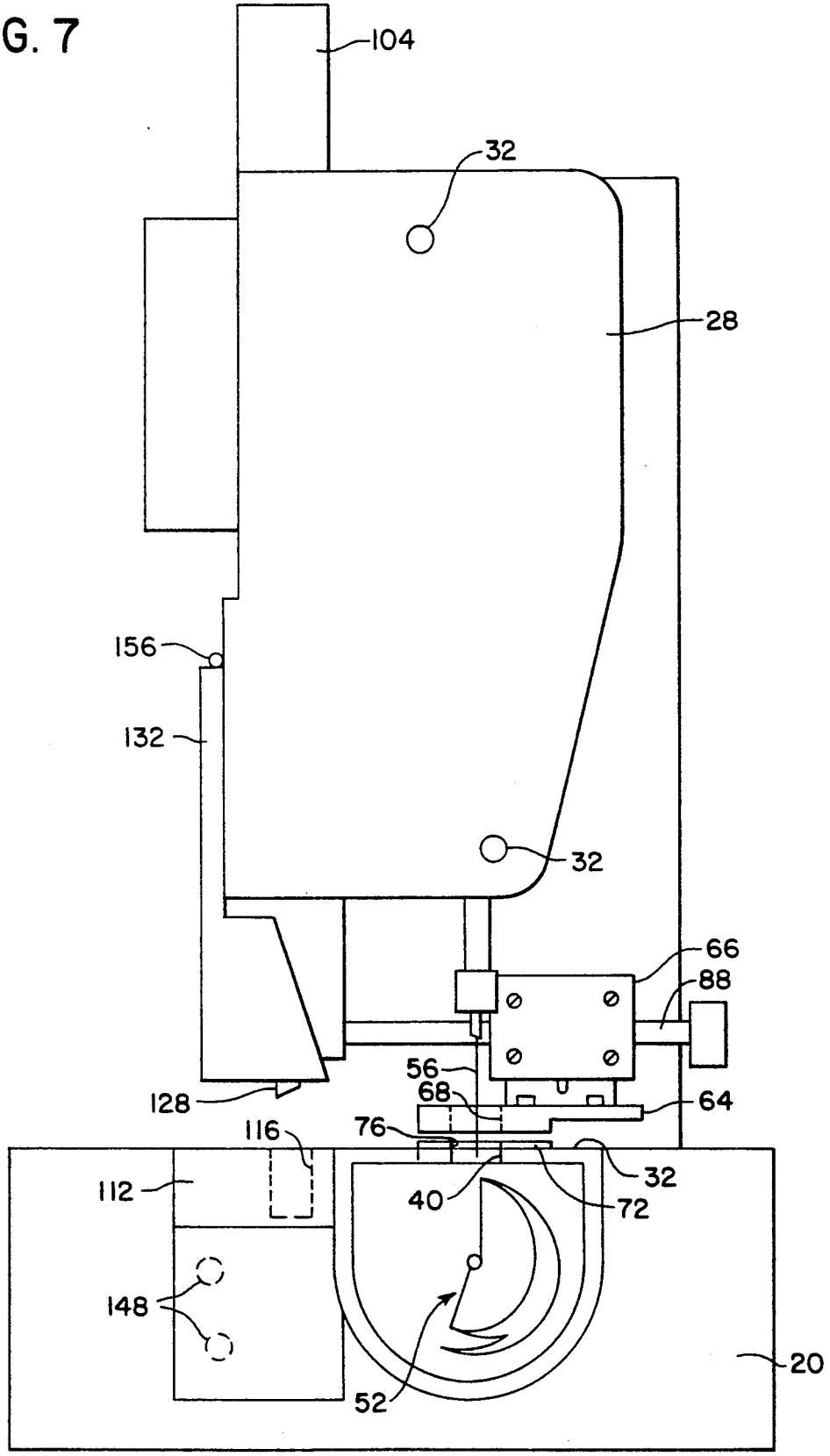
FIG. 7 is a front view of the programmable sewing machine with the kit assembly attached thereto, illustrating the positioning of the presser foot assembly and guard during sewing operations.

For purposes of enhancing operator safety during buttonhole sewing operations, a guard 132 is suitably attached to the support assembly 92, typically by a pivotal connection 156, as illustrated in FIGS. 3, 5, and 7. When the presser foot assembly 60 of the programmable sewing machine 16 is repositioned to the material removal area (FIG. 5) by the software and control motors (not shown), the bracket 66 of the presser foot assembly 60 engages with a guard wire 140 (FIGS. 2–3) attached to the guard 132 which pivots the guard 132 away from the area through which the material removal device 120 travels so that material removal operations may be performed. However, when the presser foot assembly 60 moves to the position illustrated in FIG. 7 to perform sewing operations, the guard 132 pivots to a position around and below which the material removal device 120 normally travels to restrict its downward movement in the event it is inadvertently deployed. In this regard, the cutting head 128 may pass through a guard hole 136 on the bottom of the guard 132 so that it is not damaged, as best illustrated in FIG. 8. However, the shaft 124 of the material removal device 120 is of a larger diameter than the guard hole 136 and thus inhibits further downward movement of the material removal device 120.

In order to provide a suitable surface for the material removal device 120 to engage with during material removal operations, the support plate 44 (FIG. 1) is replaced with a table 112 (FIG. 2) which is detachably connected to the programmable sewing machine 16 in a position which is substantially adjacent to and parallel with the cylinder bed 36. Positioned within the table 112, as best illustrated in FIGS. 3, 5, and 6–8, is a recessed receiver 116 in which the cutting head 128 of the material removal device 120 enters after having fully passed through the stitchable material 144. In order to enhance cutting of the stitchable material 144, the upper portion of the receiver 116 may be contoured to provide a cutting edge.

An advantage of the structural configuration of the kit assembly 12 presented herein is that it is positioned a sufficient distance from the sewing drive assembly 48 and the sewing components assembly 52, including the sewing needle 56, so as to not interfere with their normal operations. Nonetheless, the kit assembly 12 may be positioned sufficiently close to the sewing area defined by the cylinder bed 36, more particularly the sewing needle 56 and the cylinder bed hole 40, so as to not adversely affect the overall speed of buttonhole sewing operations. In this regard, preferably the distance between the centers of the recessed receiver 116 and the cylinder bed hole 40 will be about five (5) inches or less.

Installation of the present invention typically requires little if any modification of the programmable sewing machine 16. When used with a programmable sewing machine of the type illustrated in FIG. 1, the head cover 28 is detached by removing the head cover screws 32 and the support assembly 92, which preferably is configured to substantially follow the contour of the end of the head 24, is mounted to the head 24. The head cover 28 may then be positioned on the end of the support assembly 92 and the head cover screws 32, or appropriate substitutes, may be positioned through the holes in the head cover 28, the support assembly 92, and programmable sewing machine 16. In order to complete the installation, the support plate 44 is removed and the table 112 is positioned substantially adjacent to and parallel with the cylinder bed 36 and is attached to the programmable sewing machine 16 in an appropriate manner by, for instance, two fasteners 148 (FIG. 3). Although material removal operations may be manually controlled, preferably the kit assembly 12 is integrated with the software of the programmable sewing machine 16 such that fully automated operations will be provided.

When the kit assembly 12 has been properly integrated with the controlling software for the programmable sewing machine 16 and buttonhole operations are to be initiated, the stitchable material is placed in the presser foot assembly 60 of the programmable sewing machine 16 between the upper presser foot 64 and the lower presser foot 72. Thereafter, the presser foot assembly 60 is engaged as is known in the art to firmly secure the stitchable material 144. Then the presser foot assembly 60, together with the stitchable material 144, is moved to the desired position for material removal operations as generally illustrated in FIG. 5. As the presser foot assembly 60 is repositioned over the table 112, the bracket 66 engages the guard wire 140 attached to the punch guard 132 such that it pivots away from the support assembly 92 into the position illustrated in FIG. 5.

Once the desired sewing pattern has been selected, the software sends a signal to the driver 104 to activate the material removal device 120. Consequently, the material removal device 120 is driven down through the upper and lower presser foot holes 68, 76, respectively, and the stitchable material 144 until the cutting head !28 enters the receiver 116 in the table 112. After the desired portion of the stitchable material 144 has been removed, the software directs the controllers (not shown) to retract the driver shaft 108 of the driver 104 and thus the material removal device 120.

After the material removal operations are completed, the presser foot assembly 60, as directed by the software and through use of the control motors (not shown), is moved laterally toward the cylinder bed 36 along the cylinder rod 88 to align the opening in the stitchable material 144 with the sewing needle 56. During this movement of the presser foot assembly 60, the guard 132 moves into the position illustrated in FIG. 7 since the bracket 66 of the presser foot assembly 60 no longer exerts a force on the guard wire 140. When the stitchable material 144 is properly positioned relative to the sewing needle 56, the software directs the sewing drive assembly 48 to begin sewing operations through the sewing components assembly 52, including the sewing needle 56, as is well known in the art. Consequently, a buttonhole pattern is sewn around the opening in the desired manner.

Once sewing operations are completed, the software directs the controllers (not shown) to move the presser foot assembly 60, together with the stitchable material 144, in a lateral direction along the cylinder rod 88 from the position illustrated in FIG. 7 back to the initial position generally illustrated in FIG. 5. When this movement is initiated, the sewing needle 56 is in an upward position as illustrated in FIG. 5 so as to not catch on the upper presser foot 64. Moreover, as the presser foot assembly 60 is repositioned over the table 112, the bracket 66 engages the guard wire 140 attached to the guard 132 such that it pivots away from the support assembly 92 into the position illustrated in FIG. 5 to allow material removal operations to be performed. Thereafter, the cycle of material removal and sewing operations may be repeated in the above-described manner.

Although the buttonhole sewing sequence has been described as such, it can be appreciated that the sequence may be reversed. In this regard, the sewing operations would first produce the desired stitching pattern on the stitchable material 144. Thereafter, material removal operations would be performed to remove portions of the stitchable material 144 inside of the area defined by the stitching pattern. Although the same general end product is obtained by both sequences, performing material removal operations after sewing operations results in a hole or opening not having a stitched border therearound, thereby exposing some fibers of the stitchable material 144.

As can be appreciated by those skilled in the art, after buttonhole sewing operations are completed, the punch kit assembly 12 of the present invention may be disabled or entirely removed such that the programmable sewing machine 16 may be used for alternate functions. This is desirable since most programmable sewing machines are used for industrial applications and thus are quite expensive. Moreover, essentially no structural modification is required of the programmable sewing machine 16 to use the kit assembly 12 so that performance of the programmable sewing machine 16 is not adversely affected. Furthermore, material removal operations take place sufficiently close to the sewing area such that the overall speed of sewing operations is not adversely affected.

The foregoing description of the invention has been presented for purposes of illustration and description. Further, the description is not intended to limit the invention to the form disclosed herein. Consequently, variations and modifications commensurate with the above teachings, in the skill or knowledge of the art, are within the scope of the present invention. The embodiments described hereinabove are further intended to explain best modes known of practicing the invention and to enable others skilled in the art to utilize the invention in such, or other, embodiments and with the various modifications required by their particular applications or uses of the invention. It is intended that the appended claims be construed to include alternative embodiments to the extent permitted by the prior art.

What is claimed is:

1. An apparatus attachable to a sewing machine, comprising:

a kit separable from but connectable to a sewing machine that is capable of stitching patterns on stitchable material using a sewing needle, the sewing machine including a head and a cylinder bed containing components required for such sewing operations, said kit including:

first means for connection to the sewing machine;

second means for removing portions of stitchable material; and third means operatively connected to said second means. for driving said second means to cause said second means to remove the stitchable material;

said first means comprising a movable guard disposed adjacent to said second means, wherein said guard is pivotable between at least first and second positions, said guard being disabled in said first position to allow said second means to remove stitchable material, said guard preventing said second means from removing stitchable material when in said second position.

2. A method for performing buttonhole sewing operations utilizing an assembly including a programmable sewing machine, having a movable presser foot mechanism and sewing components, including a sewing needle, controlled by software for stitching preselected patterns stored in computer memory and accessible using software, and a kit assembly detachable connected to the programmable sewing machine and operatively controlled by software, comprising the steps of:

supplying a stitchable material to the assembly;

positioning the presser foot mechanism in proximity to the portion of stitchable material to be removed;

gripping the stitchable material to substantially restrict movement thereof;

removing a portion of the stitchable material to define an opening;

repositioning the presser foot mechanism to move the stitchable material to the sewing area; and sewing a preselected pattern around the opening, while the presser foot mechanism and stitchable material relative to the sewing needle.

3. A method for performing buttonhole sewing operations utilizing an assembly including a programmable sewing machine, having a movable presser foot mechanism and sewing components, including a sewing needle, controlled by software for stitching preselected patterns stored in computer memory and accessible using software, and a kit assembly detachably connected to the programmable sewing machine and operatively controlled by software, comprising the steps of:

supplying a stitchable material to the assembly;

positioning the presser foot mechanism in proximity to the portion of stitchable material to be removed;

gripping the stitchable material to substantially restrict movement thereof;

sewing a preselected pattern around the portion of stitchable material to be removed while moving the presser foot mechanism and stitchable material relative to the sewing needle;

repositioning the presser foot mechanism to move the portion of stitchable material to be removed into alignment with at least a portion of the kit assembly; and removing the portion of the stitchable material interiorly of said preselected pattern to define an opening.

* * * * *

UNITED STATES PATENT AND TRADEMARK OFFICE

CERTIFICATE OF CORRECTION

PATENT NO. : 5,158,026

DATED : October 27, 1992

INVENTOR(S) : BADILLO et al.,

It is certified that error appears in the above-identified patent and that said Letters Patent is hereby corrected as shown below:

Column 5, line 16, please delete "25".

Column 7, line 31, please delete "!28" and insert therefor --128--.

Column 9, line 9, please delete "detachable" and insert therefor --detachably--.

Column 9, line 22, please insert after the word "while" the word --moving--.

Signed and Sealed this

Twenty-first Day of June, 1994

*Attest:*

Bruce Lehman

BRUCE LEHMAN

*Attesting Officer*

*Commissioner of Patents and Trademarks*